US006443332B1

(12) United States Patent
Costea

(10) Patent No.: US 6,443,332 B1
(45) Date of Patent: Sep. 3, 2002

(54) METHOD AND APPARATUS FOR AVOIDING LOSS OF PRIME ON A FEED TUBE OF A SPRAY BOTTLE PUMP

(75) Inventor: Dan Costea, Calgary (CA)

(73) Assignee: Canda Properties, Ltd., Calgary (CA)

( * ) Notice: Subject to any disclaimer, the term of this patent is extended or adjusted under 35 U.S.C. 154(b) by 0 days.

(21) Appl. No.: 09/934,919

(22) Filed: Aug. 22, 2001

(30) Foreign Application Priority Data

Sep. 6, 2000 (CA) ..... 2317623

(51) Int. Cl.[7] ..... B67D 5/00

(52) U.S. Cl. ..... 222/321.1; 222/321.7; 222/501; 222/527; 239/587.4

(58) Field of Search ..... 222/320, 321, 222/321.7, 321.8, 321.9, 501, 527, 566–571; 239/587.1–587.6

(56) References Cited

U.S. PATENT DOCUMENTS 1,087,006 A * 2/1914 Fitzsimons ..... 239/587.4
1,869,869 A * 8/1932 Smith ..... 222/321.1
2,410,692 A * 11/1946 Strobell ..... 222/321.8
2,573,904 A * 11/1951 Grossman ..... 239/587.4
2,823,953 A * 2/1958 McGeorge ..... 222/320
4,195,692 A * 4/1980 Dion-Biro ..... 239/587.2
4,203,534 A 5/1980 Finke
4,304,342 A 12/1981 Morane
5,810,211 A * 9/1998 Shanklin et al. ..... 222/501
6,123,268 A * 9/2000 Chastine ..... 239/587.4
6,296,198 B1 * 10/2001 Tores ..... 239/587.3

FOREIGN PATENT DOCUMENTS

CA 2148916 11/1992
CA 2294856 5/1998

* cited by examiner

*Primary Examiner*—J. Casimer Jacyna
(74) *Attorney, Agent, or Firm*—Davis & Bujold, P.L.L.C.

(57) ABSTRACT

A method and apparatus for avoiding loss of prime on a feed tube of a spray bottle pump. A spray nozzle is provided having a first body and a second body. The second body is pivotally secured for omni-directional movement about a second end of the first body. A first end of the first body is attached to a terminus of a fluid discharge passage of a spray bottle. The pivotal positioning of the second body relative to the first body changes the angular orientation of fluid discharge through the fluid discharge aperture, while permitting the spray bottle to be maintained in a substantially vertical orientation to maintain prime.

8 Claims, 4 Drawing Sheets

METHOD AND APPARATUS FOR AVOIDING LOSS OF PRIME ON A FEED TUBE OF A SPRAY BOTTLE PUMP

FIELD OF THE INVENTION

The present invention relates to a method and an apparatus for avoiding a loss of prime on a feed tube of a spray bottle pump

BACKGROUND OF THE INVENTION

Spray bottle pumps have difficulty functioning when the liquid level is low in the reservoir and the bottle is tipped off vertical to direct the spray at a desired target. When the spray bottle is tipped, the feed tube is no longer submerged and the prime on the pump is lost. Once the prime is lost, the bottle must be reoriented in the vertical orientation and the pump stroked several times in order to reestablish prime.

Patent Cooperation Treaty application PCT/US93/11105 by Evans et al which was published as international publication number WO 94/11114 discloses several solutions for avoiding loss of prime. One solution involves providing a repositionable feed tube, which can be oriented at an angle to accommodate tipping of the spray bottle. Another solution involves providing a repositionable spray head, which can be oriented at a desired angle while the spray bottle is maintained in a vertical orientation. Unfortunately, the solutions proposed in the Evans et al reference require modifications to be made to the spray bottle and the spray bottle pump.

SUMMARY OF THE INVENTION

What is required is a method and an apparatus for avoiding a loss of prime on a feed tube of a spray bottle pump which can be readily retrofit onto existing spray bottles.

According to one aspect of the present invention there is provided an apparatus for avoiding loss of prime on a feed tube of a spray bottle pump. The apparatus is a spray nozzle having a first body and a second body. The first body has a first end, a second end and a fluid passage that extends from the first end to the second end. The first end of the first body is adapted for attachment to a terminus of a fluid discharge passage of a spray bottle. The second body has a fluid discharge aperture. The second body is pivotally secured for omni-directional movement about the second end of the first body. The pivotal positioning of the second body relative to the first body changing the angular orientation of fluid discharge through the fluid discharge aperture, while permitting the spray bottle to be maintained in a substantially vertical orientation to maintain prime.

There are various ways in which the first end of the first body can be connected to a fluid discharge passage of a spray bottle pump. Beneficial results have been obtained when the first end of the first body is a male member which is insertable into the fluid discharge passage of the spray bottle. It is preferred that the male member be cylindrical and have at least one feed tube engaging radial projection which resists the first end of the body from being inadvertently withdrawn from fluid discharge passage during use.

There are various ways in which the second end of the body can be pivotally connected to the second body for omni-directional movement to permit a selective angular direction for fluid discharge. Beneficial results have been obtained when a ball joint is positioned at the second end of the first body and the second body has a socket. The first body is pivotally connected to the second body by coupling the ball joint of the first body with the socket of the second body.

According to another aspect of the present invention there is provided a method for avoiding loss of prime on a feed tube of a spray bottle pump. A first step involves providing a spray nozzle substantially as described. A second step involves attaching the first end of the first body to a terminus of a fluid discharge passage of a spray bottle in place of a uni-directional spray nozzle. A third step involves adjusting the pivotal positioning of the second body relative to the first body to change the angular orientation of fluid discharge through the fluid discharge aperture, while permitting the spray bottle to be maintained in a substantially vertical orientation to maintain prime.

Although beneficial results may be obtained through the method and apparatus, described above, as the relative angular positioning of the second body and the first body is increased, it becomes more difficult to maintain the same fluid flow as when the first body and the second body are aligned. Even more beneficial results may, therefore, be obtained when a flexible conduit extends from the fluid passage at the second end of the first body to the fluid discharge aperture of the second body. The fluid flowing through the flexible conduit remains constant, regardless of the angular positioning of the second body relative to the first body.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
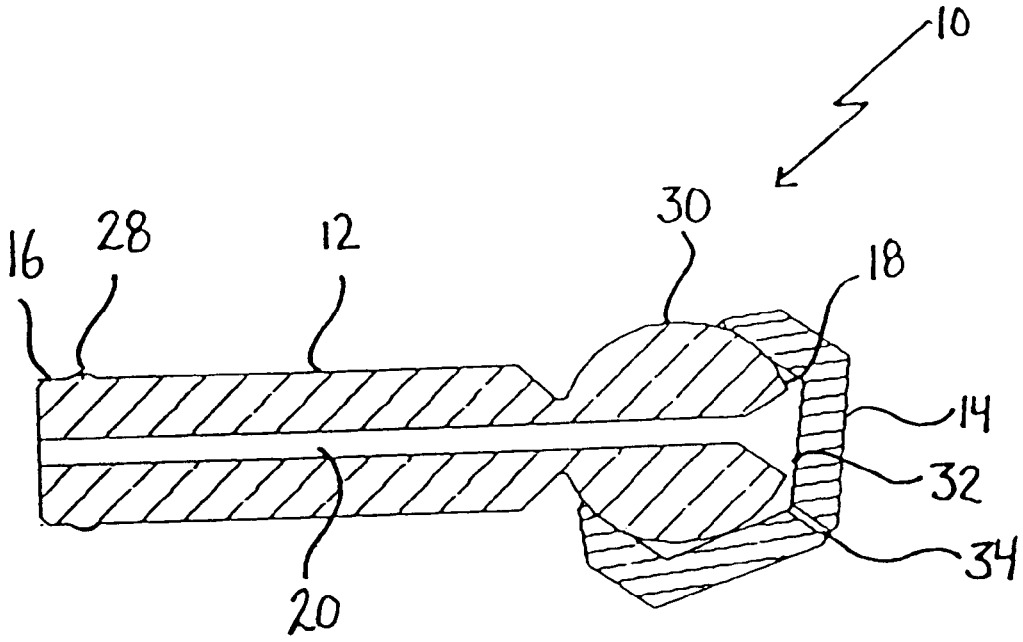
FIG. 1 is a side elevation view, in section, of a spray nozzle constructed in accordance with the teachings of the present invention.

The preferred embodiment, a spray nozzle generally identified by reference numeral 10, will now be described with reference to FIGS. 1 through 4.

Structure and Relationship of Parts

Figure 3:
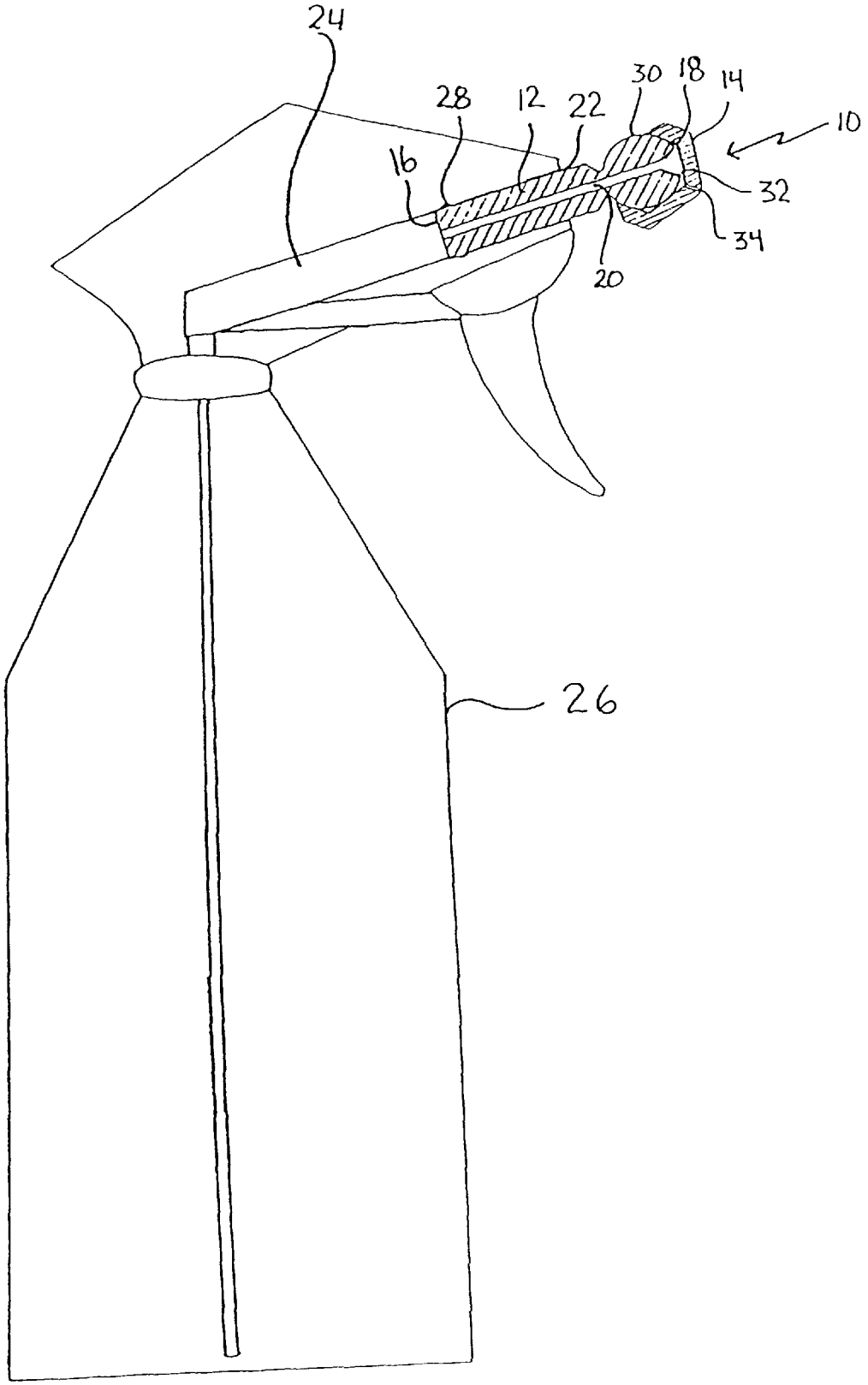
FIG. 3 is a side elevation view, in section, of the spray bottle illustrated in FIG. 2 with the spray nozzle illustrated in FIG. 1.

Referring to FIG. 1, spray nozzle 10 has a first body 12 and a second body 14. First body 12 has a first end 16, a second end 18 and a fluid passage 20 extending from first end 16 to second end 18. Referring to FIG. 3, first end 16 of first body 12 is a male member adapted for insertion into a terminus 22 of a fluid discharge passage 24 of a spray bottle 26. In the illustrated embodiment, male member 16 is cylindrical, however it will be appreciated that male member 16 can be fabricated in other shapes. Referring to FIG. 1, male member 16 has a fluid discharge passage engaging radial projection 28. A ball joint 30 is positioned at second end 18 of first body 12.

Second body 14 has a socket 32 with a fluid discharge aperture 34. Second body 14 is pivotally secured for omni-directional movement about second end 18 of first body 12 by coupling ball joint 30 of first body 12 with socket 32 of second body 14. The pivotal positioning of second body 14 relative to first body 12 changes the angular orientation of fluid discharge through fluid discharge aperture 34, while permitting spray bottle 26 to be maintained in a substantially vertical orientation to maintain prime.

Operation

Figure 2:
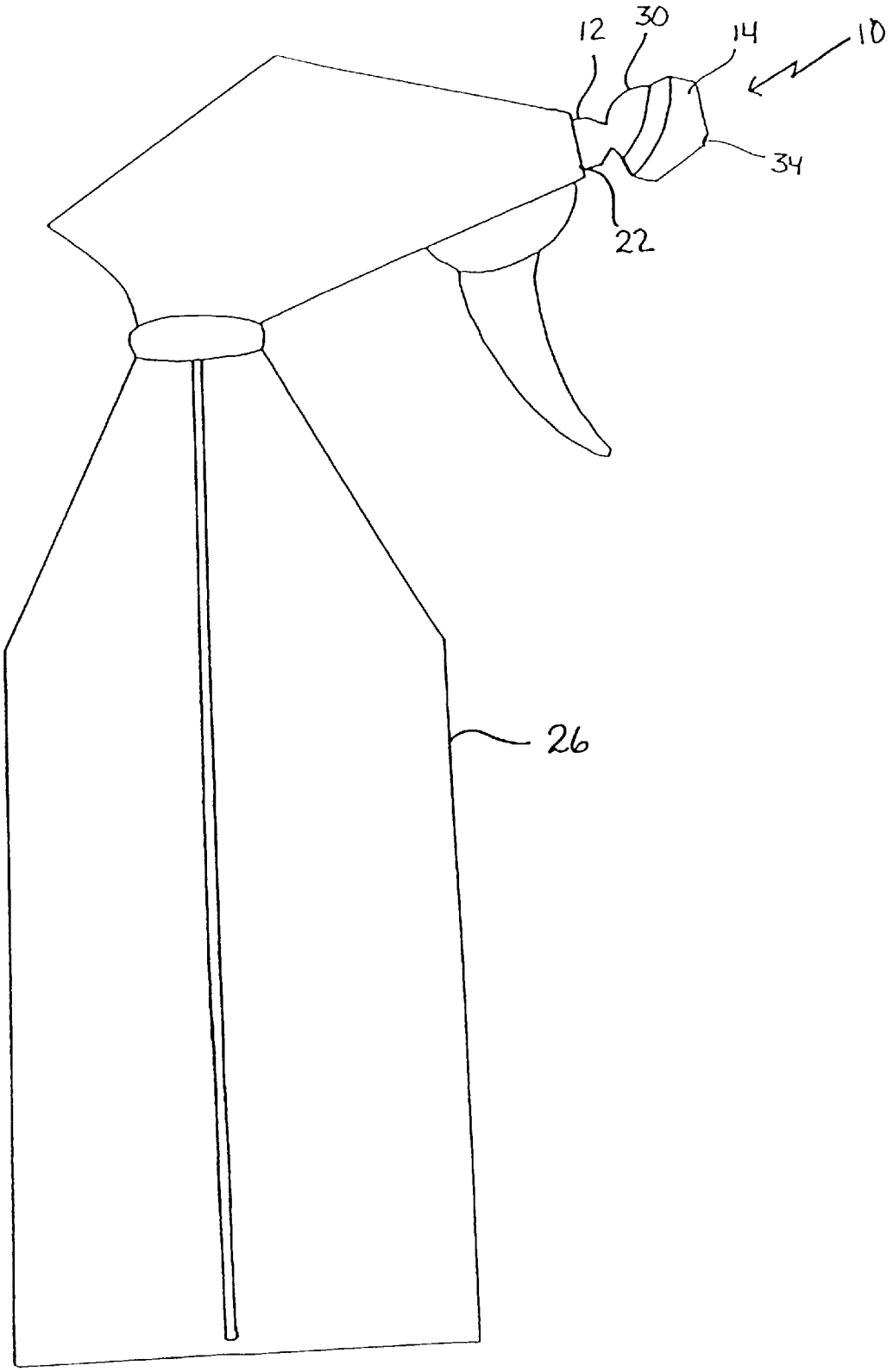
FIG. 2 is a side elevation view, of a spray bottle equipped with the spray nozzle illustrated in FIG. 1.

The use and operation of spray nozzle 10 will now be described with reference to FIGS. 1 through 4. Referring to FIG. 2, an existing spray bottle can be modified by removing the uni-directional spray nozzle that comes with the spray bottle and substituting spray nozzle 10. Referring to FIG. 3, spray nozzle 10 is secured to spray bottle 26 by inserting male member 16 of first body 12 into to terminus 22 of fluid discharge passage 24 of spray bottle 26. Accidental withdrawal of male member 16 is prevented by fluid discharge passage engaging radial projection 28.

Once spray nozzle 10 is in position, the pivotal positioning of second body 14 relative to first body 16 can be adjusted to change the angular orientation of fluid discharge through fluid discharge aperture 34, while permitting spray bottle 26 to be maintained in a substantially vertical orientation to maintain prime.

The omni-directional adjustment of socket 32 of second body 14 relative to ball joint 30 of first body 12 is over a 90 degree radius, thereby permitting fluid discharge at a 45 degree upward angle, a 45 degree downward angle and a 45 degree angle to either side.

Previous solutions for maintaining prime required a specially configured spray bottle. In comparison, virtually every existing spray bottle on the market can be readily modified to better maintain prime by removing the existing spray nozzle from the bottle and replacing it with nozzle 10.

Variations and Alternative Embodiments

Figure 4:
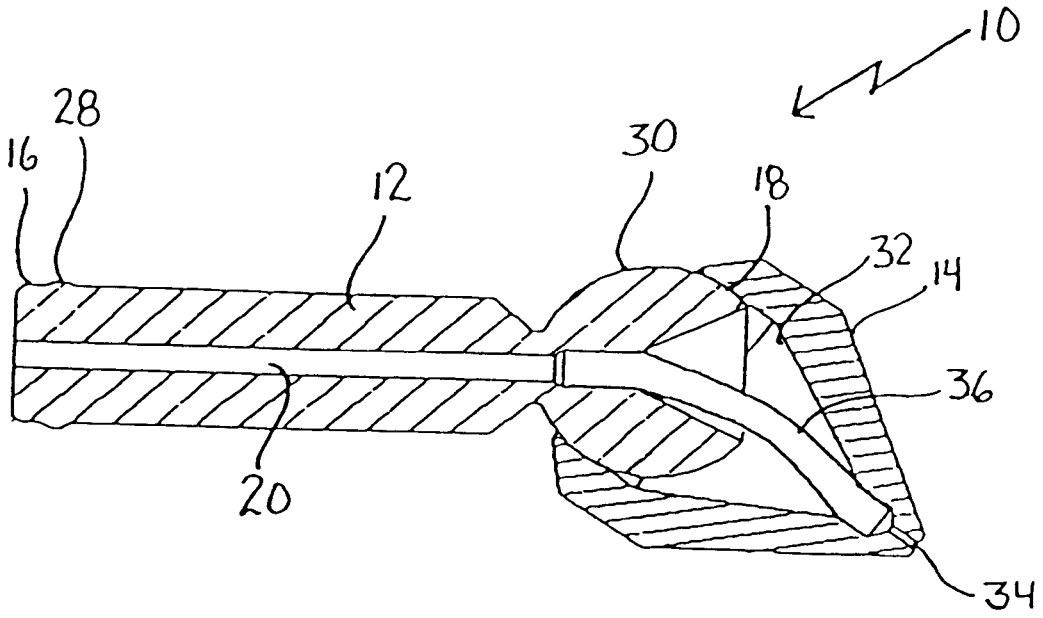
FIG. 4 is a side elevation view, in section, of a second embodiment of spray nozzle constructed in accordance with the teachings of the present invention.

Referring to FIG. 4, there is provided a spray nozzle 10 that has a flexible conduit 36 extending from fluid passage 20 at second end 18 of first body 12 to fluid discharge aperture 34 of second body 14. As the relative angular positioning of second body 14 and first body 12 is increased, it becomes more difficult to maintain the same fluid flow as when fluid passage 20 first body 12 and fluid discharge aperture 34 second body 14 are axially aligned. When spray nozzle 10 is equipped with flexible conduit 36 the fluid flowing through flexible conduit 36 remains constant, regardless of the angular positioning of second body 14 relative to first body 12.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. An apparatus for avoiding loss of prime on a feed tube of a spray bottle pump, comprising:

a spray nozzle having a first body and a second body;

the first body having a first end, a second end and a fluid passage extending from the first end to the second end, the first end of the first body being a male member adapted for insertion into to a terminus of a fluid discharge passage of a spray bottle, a ball joint being positioned at the second end of the first body;

the second body having a socket with a fluid discharge aperture, in operation the socket filling with fluid, excess fluid being discharged through the fluid discharge aperture as fluid under pressure continues to enter the socket, the second body being pivotally secured for omni-directional movement about the second end of the first body by coupling the ball joint of the first body with the socket of the second body, the pivotal positioning of the second body relative to the first body changing the angular orientation of fluid discharge through the fluid discharge aperture, while permitting the spray bottle to be maintained in a substantially vertical orientation to maintain prime.

2. An apparatus for avoiding loss of prime on a feed tube of a spray bottle pump, comprising:

a spray nozzle having a first body and a second body;

the first body having a first end, a second end and a fluid passage extending from the first end to the second end, the first end of the first body being a male member adapted for insertion into to a terminus of a fluid discharge passage of a spray bottle, a ball joint being positioned at the second end of the first body;

the second body having a socket with a fluid discharge aperture, the second body being pivotally secured for omni-directional movement about the second end of the first body by coupling the ball joint of the first body with the socket of the second body, the pivotal positioning of the second body relative to the first body changing the angular orientation of fluid discharge through the fluid discharge aperture, while permitting the spray bottle to be maintained in a substantially vertical orientation to maintain prime;

the male member is cylindrical and has at least one fluid discharge passage engaging radial projection.

3. An apparatus for avoiding loss of prime on a feed tube of a spray bottle pump, comprising:

a spray nozzle having a first body and a second body;

the first body having a first end, a second end and a fluid passage extending from the first end to the second end, the first end of the first body being a male member adapted for insertion into to a terminus of a fluid discharge passage of a spray bottle, a ball joint being positioned at the second end of the first body;

the second body having a socket with a fluid discharge aperture, the second body being pivotally secured for omni-directional movement about the second end of the first body by coupling the ball joint of the first body with the socket of the second body, the pivotal positioning of the second body relative to the first body changing the angular orientation of fluid discharge through the fluid discharge aperture, while permitting the spray bottle to be maintained in a substantially vertical orientation to maintain prime;

a flexible conduit extending from the fluid passage at the second end of the first body to the fluid discharge aperture of the second body.

4. The apparatus as defined in claim 3, wherein omni-directional adjustment of the socket of the second body relative to the ball of the first body being over at least a 90 degree radius, thereby permitting fluid discharge at a 45 degree upward angle, a 45 degree downward angle and a 45 degree angle to either side.

5. An method for avoiding loss of prime on a feed tube of a spray bottle pump, comprising:

providing a spray nozzle having a first body and a second body, the first body having a first end, a second end and a fluid passage extending from the first end to the second end, the first end of the first body being a male member, a ball joint being positioned at the second end of the first body, the second body having a socket with a fluid discharge aperture, the second body being pivotally secured for omni-directional movement about the second end of the first body by coupling the ball joint of the first body with the socket of the second body;

inserting the male member of the first body into to a terminus of a fluid discharge passage of a spray bottle;

adjusting the pivotal positioning of the second body relative to the first body to change the angular orientation of fluid discharge through the fluid discharge aperture, while permitting the spray bottle to be maintained in a substantially vertical orientation to maintain prime;

filling with the socket with fluid, excess fluid being discharged through the fluid discharge aperture as fluid under pressure continues to enter the socket.

6. An method for avoiding loss of prime on a feed tube of a spray bottle pump, comprising:

providing a spray nozzle having a first body and a second body, the first body having a first end, a second end and a fluid passage extending from the first end to the second end, the first end of the first body being a male member, a ball joint being positioned at the second end of the first body, the second body having a socket with a fluid discharge aperture, the second body being pivotally secured for omni-directional movement about the second end of the first body by coupling the ball joint of the first body with the socket of the second body;

inserting the male member of the first body into to a terminus of a fluid discharge passage of a spray bottle, the male member being cylindrical and having at least one fluid discharge passage engaging radial projection;

adjusting the pivotal positioning of the second body relative to the first body to change the angular orientation of fluid discharge through the fluid discharge aperture, while permitting the spray bottle to be maintained in a substantially vertical orientation to maintain prime.

7. An method for avoiding loss of prime on a feed tube of a spray bottle pump, comprising:

providing a spray nozzle having a first body and a second body, the first body having a first end, a second end and a fluid passage extending from the first end to the second end, the first end of the first body being a male member, a ball joint being positioned at the second end of the first body, the second body having a socket with a fluid discharge aperture, the second body being pivotally secured for omni-directional movement about the second end of the first body by coupling the ball joint of the first body with the socket of the second body, a flexible conduit extending from the fluid passage at the second end of the first body to the fluid discharge aperture of the second body;

inserting the male member of the first body into to a terminus of a fluid discharge passage of a spray bottle;

adjusting the pivotal positioning of the second body relative to the first body to change the angular orientation of fluid discharge through the fluid discharge aperture, while permitting the spray bottle to be maintained in a substantially vertical orientation to maintain prime.

8. The method as defined in claim 7, omni-directional adjustment of the socket of the second body relative to the ball of the first body being over at least a 90 degree radius, thereby permitting fluid discharge at a 45 degree upward angle, a 45 degree downward angle and a 45 degree angle to either side.

* * * * *